US007945994B2

(12) United States Patent
Dallas et al.

(10) Patent No.: US 7,945,994 B2
(45) Date of Patent: May 24, 2011

(54) TWO PIECE CARRIER AND BALANCE ASSEMBLY

(75) Inventors: Tobias Peter Dallas, Rochester, NY (US); Douglas E Zinter, Rochester, NY (US); Wilbur James Kellum, Hilton, NY (US); Richard S deNormand, Victor, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 293 days.

(21) Appl. No.: 12/049,536

(22) Filed: Mar. 17, 2008

(65) Prior Publication Data

US 2008/0229664 A1 Sep. 25, 2008

Related U.S. Application Data

(60) Provisional application No. 60/895,536, filed on Mar. 19, 2007.

(51) Int. Cl.
*E05D 13/00* (2006.01)

(52) U.S. Cl. ..... 16/193; 49/181

(58) Field of Classification Search ..... 16/197, 16/193; 49/181, 445–447, 176
See application file for complete search history.

(56) References Cited

U.S. PATENT DOCUMENTS

| | | | | |
|---|---|---|---|---|
| 4,506,478 | A * | 3/1985 | Anderson | 49/181 |
| 5,873,199 | A * | 2/1999 | Meunier et al. | 49/181 |
| 5,927,013 | A * | 7/1999 | Slocomb et al. | 49/181 |
| 6,041,475 | A * | 3/2000 | Nidelkoff | 16/193 |
| 6,041,476 | A * | 3/2000 | deNormand | 16/197 |
| 6,119,398 | A * | 9/2000 | Yates, Jr. | 49/181 |
| 6,622,342 | B1 * | 9/2003 | Annes et al. | 16/197 |
| 6,931,788 | B2 | 8/2005 | Uken et al. | |
| 2008/0086840 | A1 * | 4/2008 | deNormand et al. | 16/193 |

* cited by examiner

*Primary Examiner* — William L. Miller
(74) *Attorney, Agent, or Firm* — Harness, Dickey & Pierce, P.L.C.

(57) ABSTRACT

A carrier and balance assembly for installation into the jamb channel of a window frame. The carrier and balance assembly are capable of being installed into the jamb channel optionally either as a single assembly or as two separate components. The two separate components are the carrier and a hanger-balance subassembly. The advantage of installing the carrier and balance assembly as two separate components is that such installation can occur after the assembly of the window frame and even after installation of the window into the wall of a building. Once the carrier and hanger-balance subassembly are separately installed in the jamb channel, they are then non-permanently locked together. Should any part of the carrier and balance assembly become damaged, replacement is performed by simply reversing the process described above without having to damage the jamb channel.

14 Claims, 14 Drawing Sheets

TWO PIECE CARRIER AND BALANCE ASSEMBLY

FIELD OF THE INVENTION

The invention pertains to the field of window sash balance systems. More particularly, the invention pertains to a two piece carrier and balance assembly and method for use with a variety of sash balances.

BACKGROUND OF THE INVENTION

This invention relates to both single and double hung window systems. Single hung window systems have only a single sash and double hung windows have two sashes, each of which are inserted into jamb channels to enable the vertical movement of the sashes in the window system. A locking pivot facilitates the cleaning and/or removal of each sash by allowing the sash to be tilted with respect to the window frame. Carriers are used to control the vertical movement of the sash throughout the jamb channel and facilitate the pivoting of the sash by lockingly engaging the sash to the jamb channel as the sash is pivoted. The pivot means can be a cylindrical rod or guide pin that inserts into the opening of a rotatable cam located in the carrier. As the cam rotates, it urges locking members forcibly against the walls of the jamb channel to secure the carrier and thus the sash in place.

The initial assembly of pivotable windows can be complex. Additionally, in order to replace an aged, broken or malfunctioning carrier or balance, a portion of the jamb channel often must be deformed or entirely removed and replaced to gain access to the defective part. Also, since conventional balance systems consist of an integral balance/carrier assembly, the entire assembly must be replaced even though only one element may be defective. It is desirable, therefore, to provide a carrier and balance system that will facilitate the initial assembly of the window, permit easier removal and replacement of defective parts of the sash balance system once the window has been installed in the wall of a building and allow the replacement of only the defective part rather than the entire carrier and balance assembly.

SUMMARY OF THE INVENTION

The present invention is a window carrier and balance assembly method for installing the device into or removing it from the jamb channel of a window frame. The carrier and balance assembly contains a carrier having a substantially "T" shaped configuration, a hanger non-permanently secured to the carrier and a balance either permanently or non-permanently secured to the hanger. The carrier contains a rotatable cam with a substantially central opening for engagement with a pivot guide pin connected to each stile of the sash. Diametrically opposed shoulders are located at a first end of the carrier to retain the carrier within the jamb channel. At the other, or second, end of the carrier is a locking tab which inserts into a mating locking channel to non-permanently but securely connect the carrier to the hanger. Shoulders are located at a first end of the hanger to retain the hanger within the jamb channel. A balance is connected to the other, or second, end of the hanger.

The carrier and balance assembly can be installed in the jamb channel as a single assembly or as two components. If installation is performed as a single assembly, the carrier, hanger and balance are assembled together prior to being installed in the jamb channel. In this case, the entire assembly is inserted through either end of the jamb channel prior to completing the assembly of the window frame. However, it is preferred that the carrier and balance assembly of the invention be inserted into the jamb channel as two separate components, the carrier being one component and the hanger-balance subassembly being the other component. This method allows assembly of the window frame before the installation of the carrier and balance mechanism into the jamb channel. This method is performed by orienting the axis of the shoulders of the carrier parallel to the axis of the jamb channel, inserting the carrier into the jamb channel and rotating the carrier 90 degrees so that the shoulders are now perpendicular to the axis of the jamb channel. The jamb channel is substantially "U" shaped, having two opposing side walls and a back wall. Each of the open edges of the side walls has a flange bent over at a substantially 90 degree angle to the plane of its corresponding side wall. The flanges run the length of and overhang the entire opening of the jamb channel. As the carrier is rotated 90 degrees after being inserted into the jamb channel, the shoulders abut the flanges in order to prevent the carrier from falling out of the jamb channel. The hanger is connected to the sash balance to form a hanger-balance subassembly by any one of a variety of conventional connection means depending on the design of the balance used. Similar to installation of the carrier, the hanger-balance subassembly is oriented so that the axis of the shoulders of the hanger is substantially parallel to the axis of the jamb channel. After the hanger is inserted into the jamb channel, it is rotated approximately 90 degrees so that the shoulders of the hanger abut the flanges in order to prevent the hanger from falling out of the jamb channel.

Once the carrier and the hanger-balance subassembly are separately inserted into the jamb channel, they are ready to be locked together. The first step is to lay the carrier against the back wall of the jamb channel so that its locking tab is oriented toward the hanger. This aligns the locking channel on the hanger with the locking tab on the carrier. The locking tab is inserted into the locking channel and the hanger-balance subassembly is inclined into the jamb channel until the balance portion rests against the back wall. A projection on the carrier operatively engages a ledge on the hanger which non-permanently locks the carrier and the hanger together.

In the event that one or more of the component parts of the carrier and balance assembly fails or otherwise becomes defective and must be replaced, the assembly operation can be reversed so that the individual defective part can be removed without damaging the jamb channel. This makes repair of the carrier and balance assembly relatively inexpensive since only the defective part need be removed. It is also easy enough to have the homeowner (or building maintenance personnel) perform the repair, which ultimately saves the window manufacturer the expense of having to send a repairman to the location of the installed window.

DETAILED DESCRIPTION OF THE INVENTION

Figure 1A:
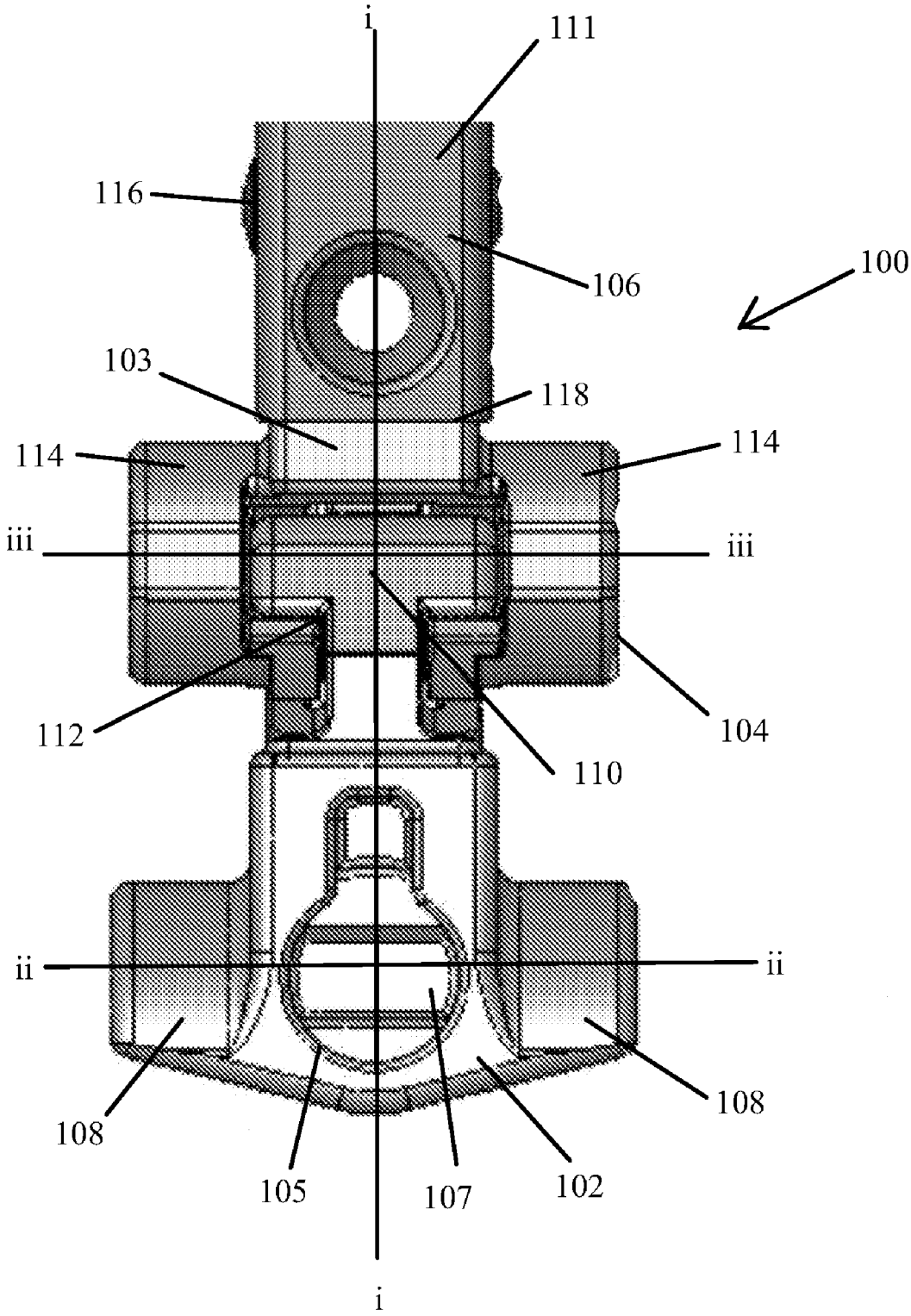
FIG. 1A shows a top plan view of the two piece carrier and balance assembly of the invention with an inverted block and tackle balance.
Figure 1B:
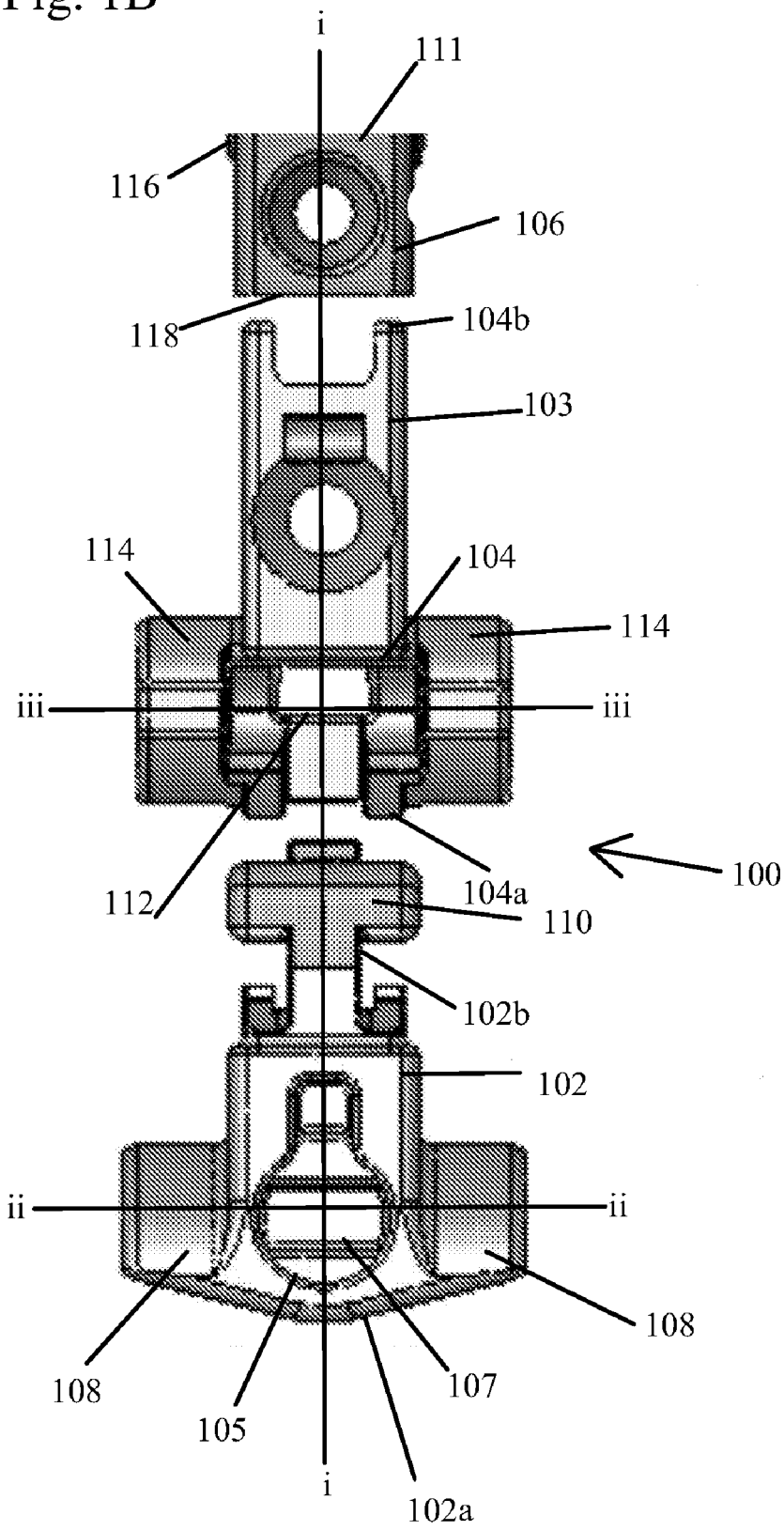
FIG. 1B shows an exploded top plan view of the inventive two piece carrier and balance assembly of FIG. 1A.
Figure 6A:
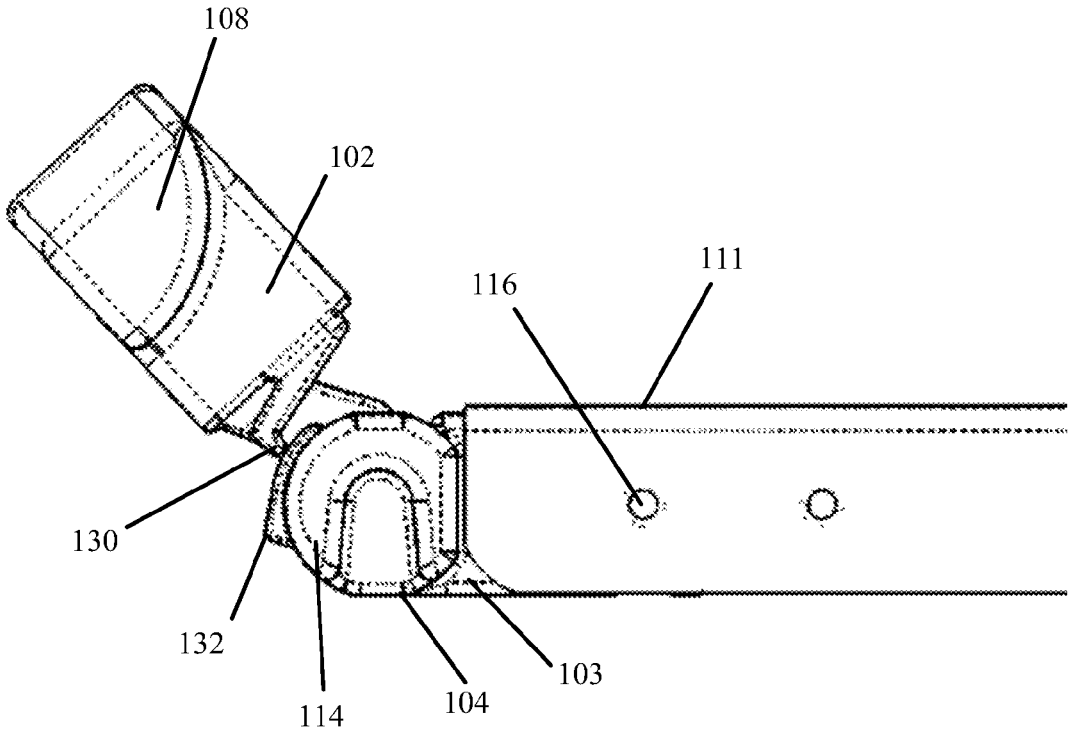
FIG. 6A shows a side perspective view of process of locking of the balance and hanger components.
Figure 6B:
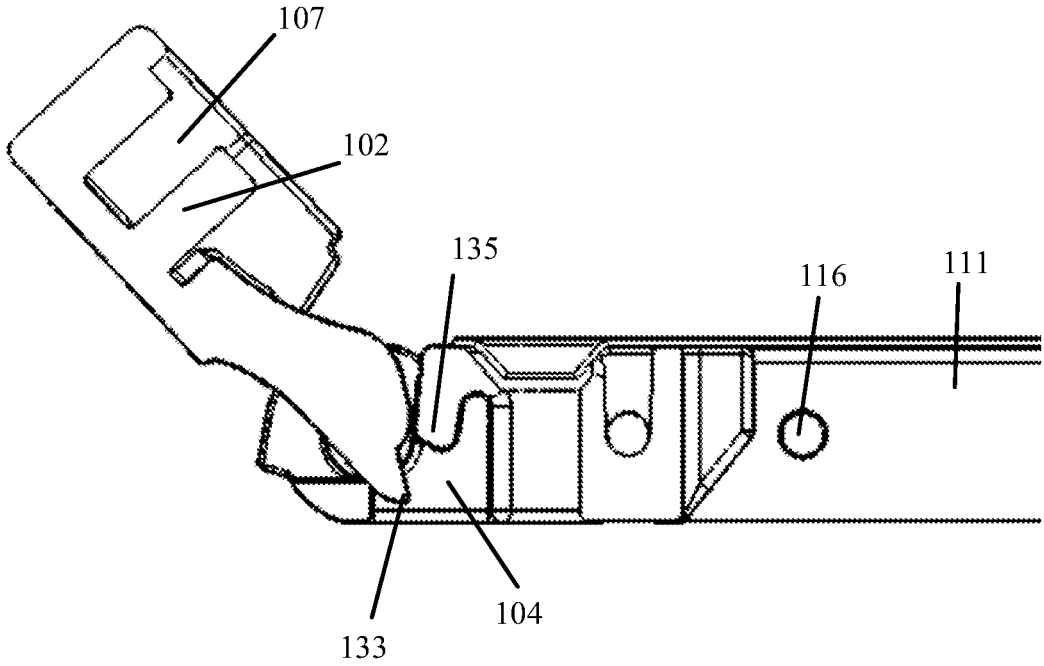
FIG. 6B shows a cross section of FIG. 6A.
Figure 7A:
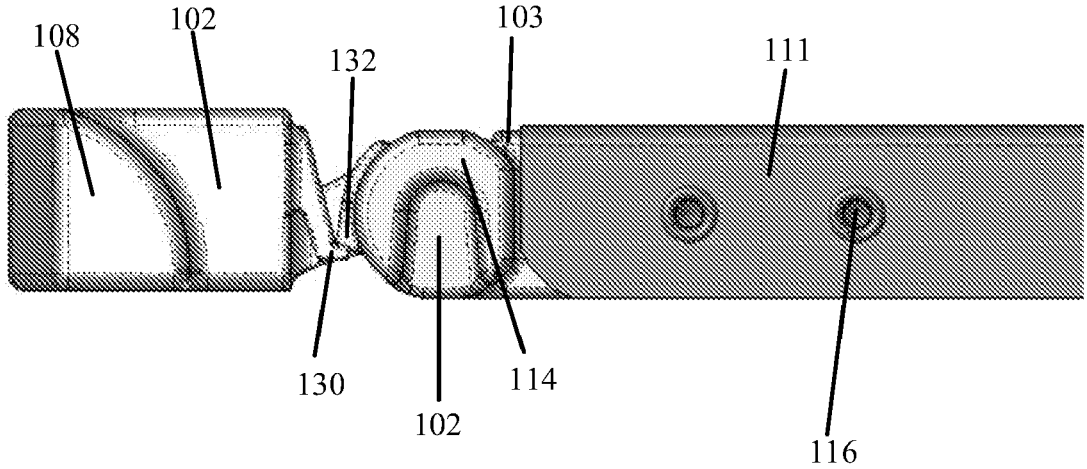
FIG. 7A shows a partial cut away view after the locking together of the balance and holder components.
Figure 7B:
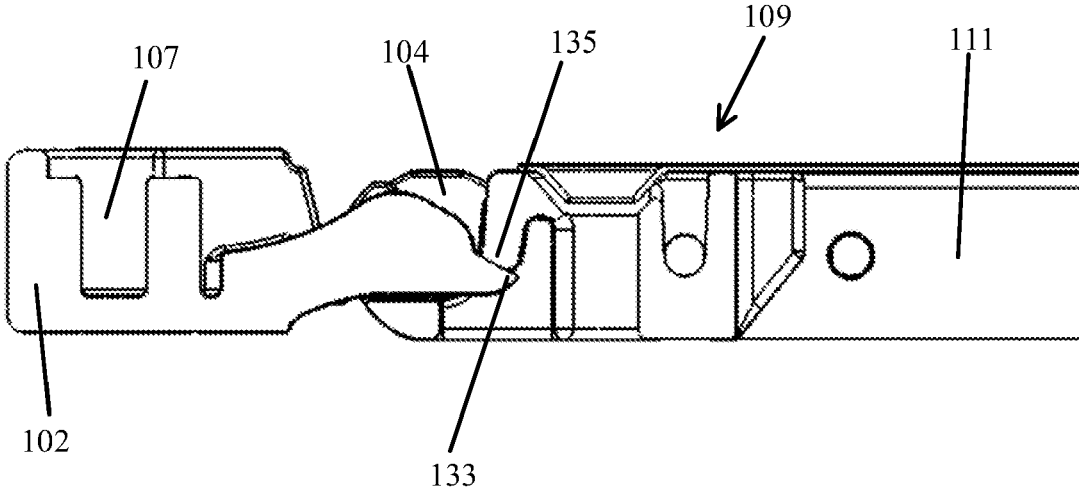
FIG. 7B shows a center plane cross section view of after the locking together of the balance and holder components.
Figure 8A:
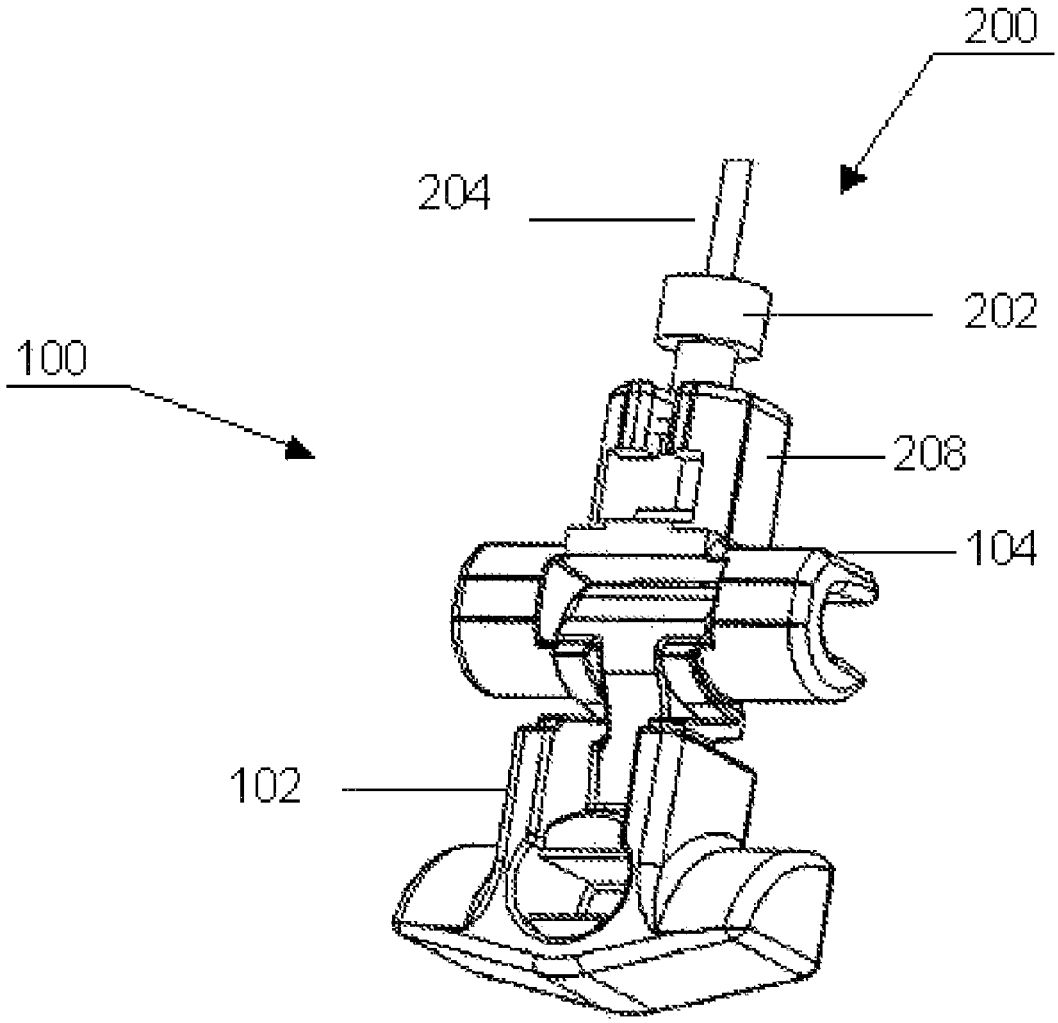
FIG. 8A shows the carrier and balance assembly using a conventional block and tackle balance.
Figure 8B:
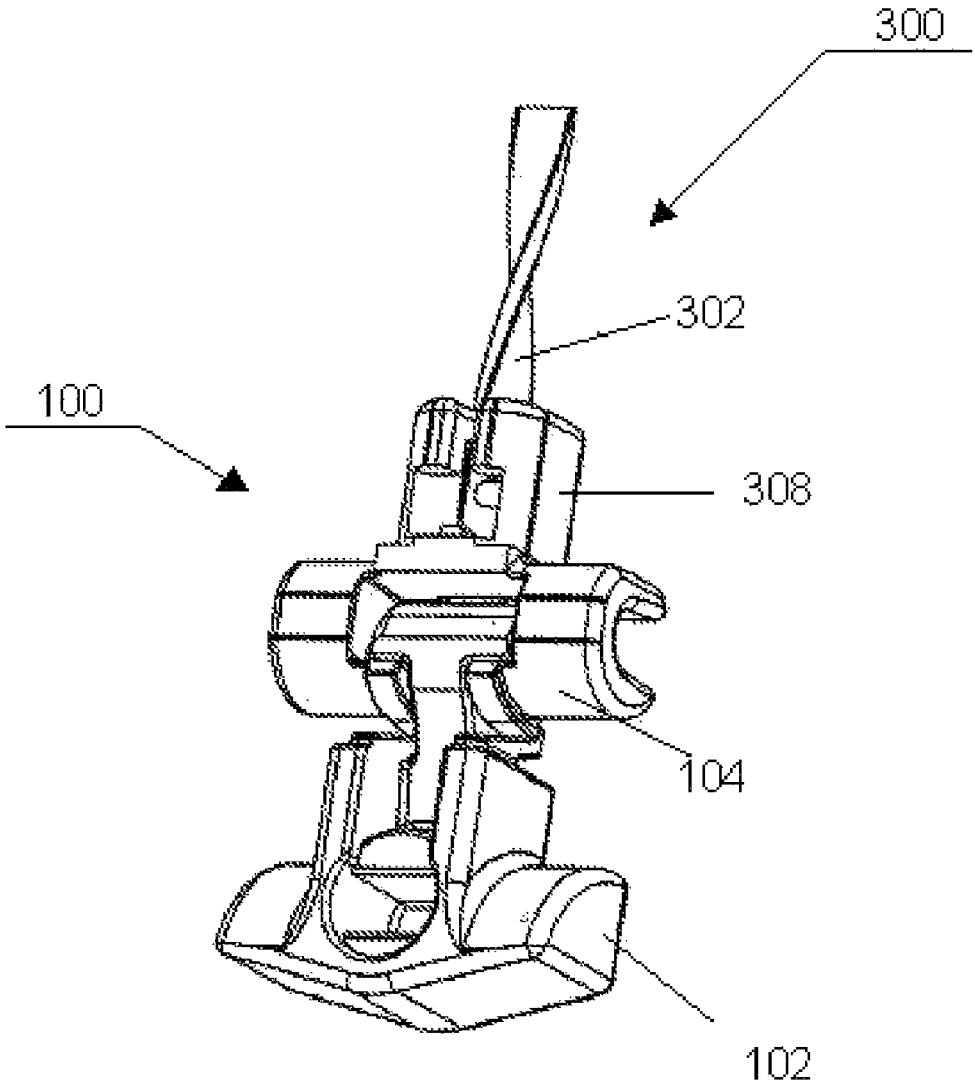
FIG. 8B shows the carrier and balance assembly using a conventional spiral balance.
Figure 8C:
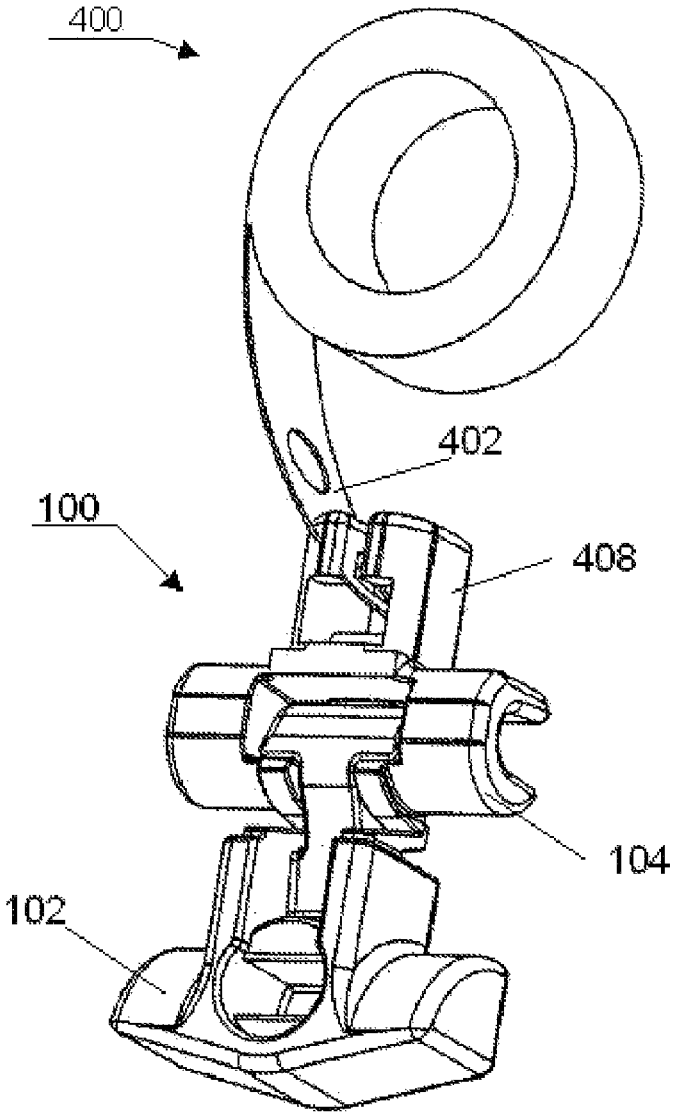
FIG. 8C shows the carrier and balance assembly using a conventional constant force spring balance.

Referring to FIGS. 1A and 1B, the window carrier and balance assembly 100 of the present invention is shown. The carrier and balance assembly 100 consists of a carrier 102, a hanger 104 non-permanently secured to carrier 102 and a balance 106 that is secured to the hanger. The balance shown in FIGS. 1A through 7B is a conventional inverted block and tackle balance. However, within the context of the present invention, other balance designs may be used, some examples of which are shown in FIGS. 8A-8C. The carrier 102 has a first end 102*a* and a second end 102*b*. At the first end 102*a* are retention shoulders 108 having an axis ii-ii and locking means that consists of a conventional rotatable cam 105 having a central opening 107 for engagement with a guide pin located on each stile of the sash (not shown). Once the guide pin is inserted into the opening 107 and then rotated by tilting the sash, the cam also rotates. The rotation of the cam causes the locking means to exert an outwardly biasing force against both side walls of jamb channel or, alternatively, against both the back wall and flanges of the side walls, depending on the design of the locking means to temporarily secure the sash in place along the jamb channel.

Referring to FIG. 1B, at the second end 102*b* of carrier 102 is an integral locking tab 110 for insertion into the hanger 104 to non-permanently but securely connect the carrier 102 and the hanger 104 together. Hanger 104 has a first end 104*a* and a second end 104*b*. At the first end 104*a* are shoulders 114 which have an axis iii-iii and a locking channel 112. The shoulders 114 retain the hanger within jamb channel 120. A first end 118 of the containment shaft 111 of balance 106 is connected to extension 103 located at the second end 104*b* of hanger 104. Using a conventional inverted block and tackle balance, the hanger 104 and balance 106 may secured together by connection means 116, which might include, for example, a screw, a rivet, a locking pin or resilient snaps. If the retention means is a screw, the hanger 104 can easily be disconnected from the balance 106 by simply removing the screw. If a locking pin which joins the opposing walls of the balance is used, the second end 104*b* of the hanger 104 may include a cut-out on its side walls to enable the hanger to be angled under the locking pin and snapped into place. Removal is relative easy and is achieved by simply reversing the installation process. If resilient snaps are used, outwardly extending tabs on each of the side walls of the hanger 104 would non-permanently engage mating holes in the side walls of the balance 106. In this case, removal would require forcing the tabs inward through the holes in the walls of the balance. If, however, a rivet is used as the connection means, the hanger and balance are permanently engaged and removal would require cutting through the rivet.

The types of balances 106 that may be used with the carrier and balance assembly 100 of the invention is not limited and are well known in the art. Examples of conventional balances include (see FIG. 8A) inverted block and tackle mechanisms, spiral rod/torsion spring mechanisms (see FIG. 8B), constant force spring mechanisms (see FIG. 8C), elastomeric devices, linear slides or electric powered mechanisms, such as those that might employ a stepper motor.

The carrier and balance assembly 100 may be inserted into the jamb channel 120 as a single assembly or as two separate components. If installation is performed as a single assembly, the carrier 102, hanger 104 and balance 106 are pre-assembled together prior to being installed in the jamb channel 120. In this process, the entire carrier and balance assembly 100 is inserted through either end of the jamb channel 120 prior to assembly of the window frame.

Figure 2A:
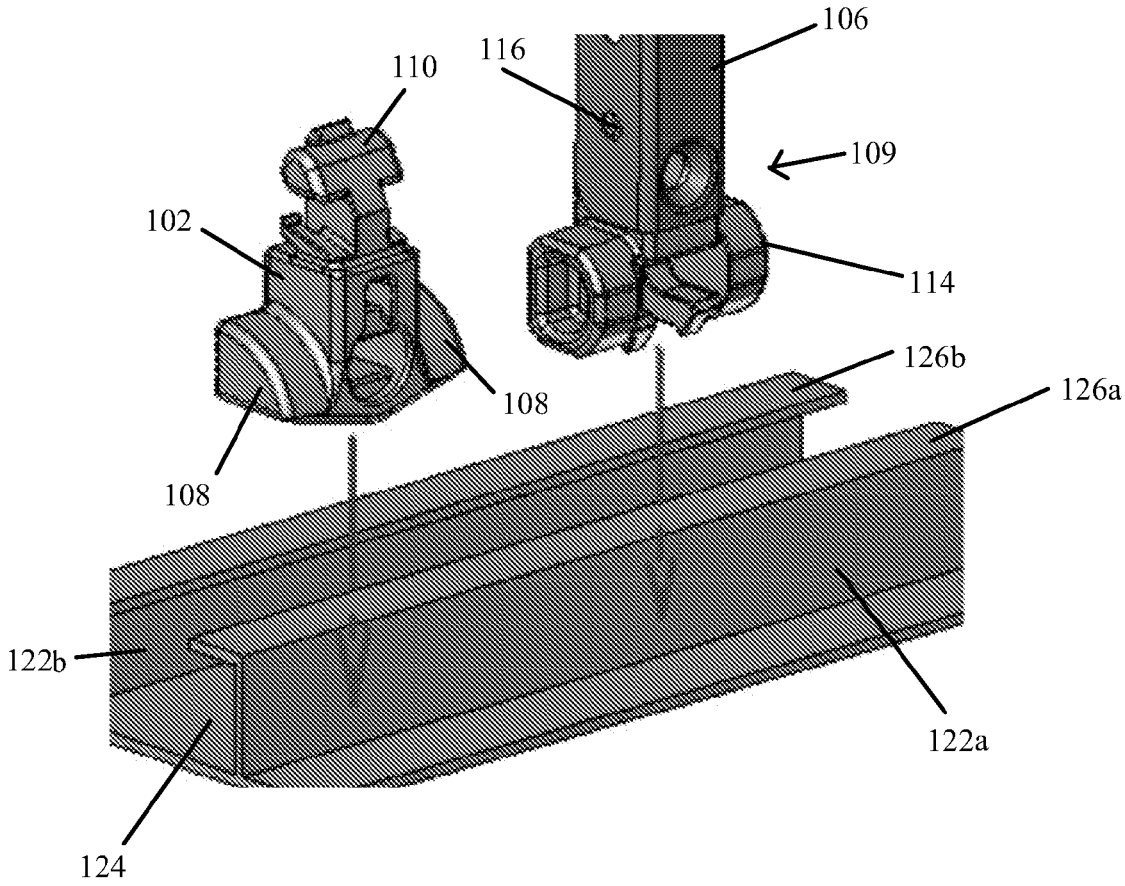
FIG. 2A shows the two separate parts of the inventive carrier and balance assembly being aligned with the jamb channel of a window frame.
Figure 2B:
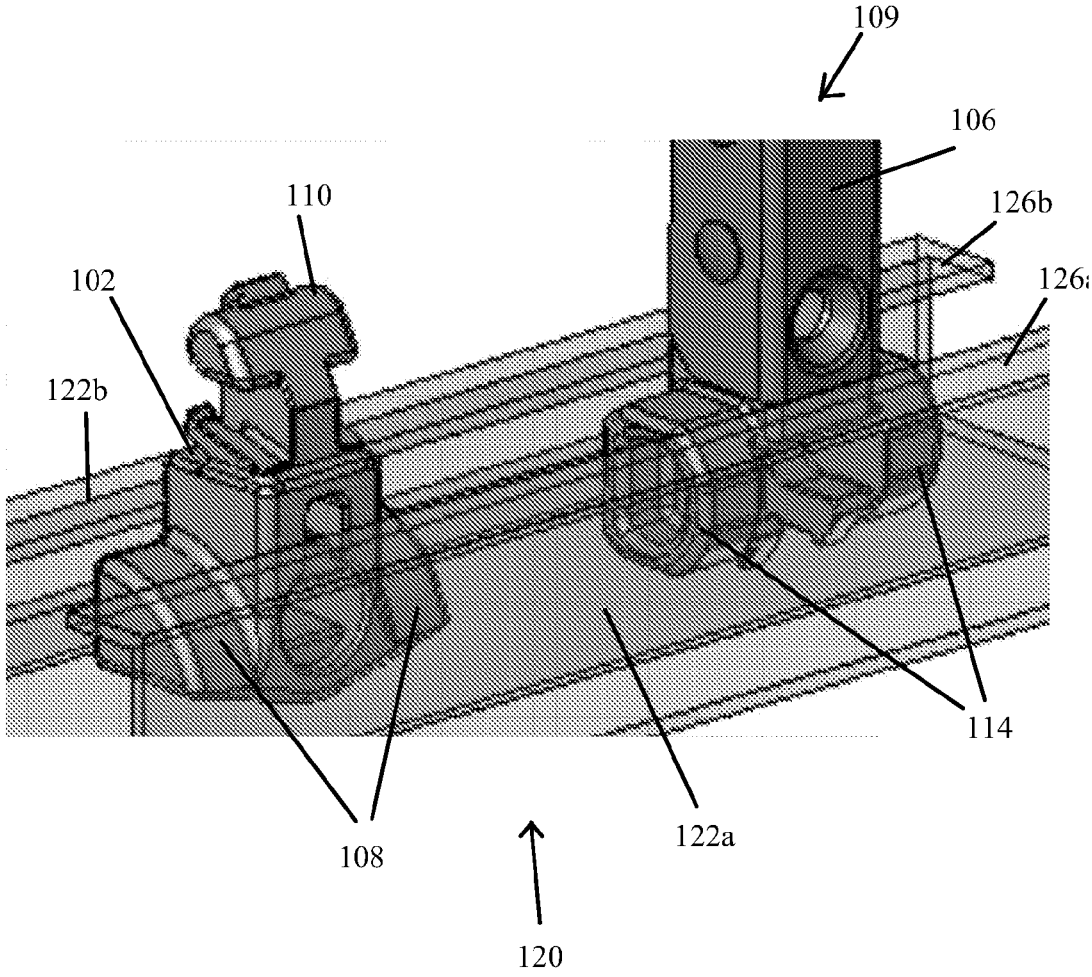
FIG. 2B shows the two separate parts of the inventive carrier and balance assembly after insertion into the jamb channel.

However, referring to FIGS. 2A and 2B, the preferred means of assembly is by first joining the hanger 104 and the balance 106 into a hanger-balance subassembly 109 and then installing the carrier 102 and hanger-balance subassembly 109 separately into the jamb channel 120. This method allows for the complete assembly of the entire window frame before the installation of the separate components of the carrier and balance assembly 100 into the jamb channel 120. This installation method is performed by orienting the axis ii-ii of shoulders 108 of the carrier 102 parallel to the axis i-i of the jamb channel 120, inserting the carrier into the jamb channel and then rotating the carrier 90 degrees so that the shoulders 108 are now substantially perpendicular to the axis i-i of jamb channel 120. The jamb channel 120 is substantially "U" shaped, having two opposing side walls 122*a* and 122*b* and a back wall 124. Each of the open edges of the side walls 122*a* and 122*b* have an integrally formed flange 126*a* and 126*b*, respectively, each of which are bent substantially at a 90 degree angle to the plane of its adjoining side wall. The flanges 126*a* and 126*b* run the length of and overhang the opening of the jamb channel 120.

Figure 3:
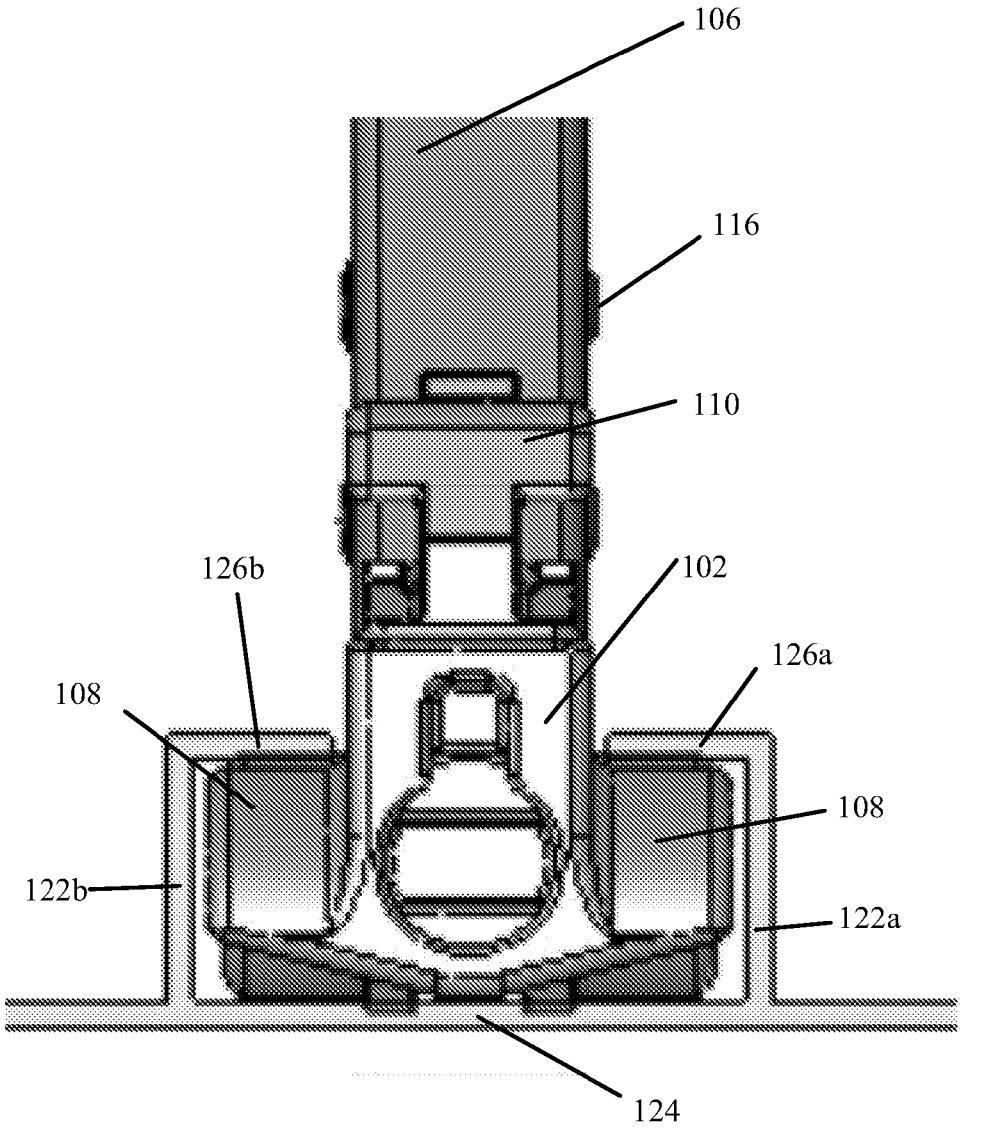
FIG. 3 shows an end perspective cross section view of the jamb channel after rotation of the two separate parts of the inventive carrier and balance assembly.

Referring to FIG. 3, as the carrier 102 is rotated 90 degrees after being inserted into the jamb channel 120, the flanges 126*a* and 126*b* abut the shoulders 108 to prevent the carrier 102 from disengagement with the jamb channel 120. Similarly, the hanger-balance subassembly 109 is oriented so that the axis iii-iii of the shoulders 114 of the hanger 104 is substantially parallel to the axis i-i of the jamb channel 120. After hanger 104 is inserted into the jamb channel 120, it is rotated approximately 90 degrees so that the flanges 126*a* and 126*b* of the side walls abut shoulders 114 to prevent the hanger 104 from disengagement with jamb channel 120.

Figure 4:
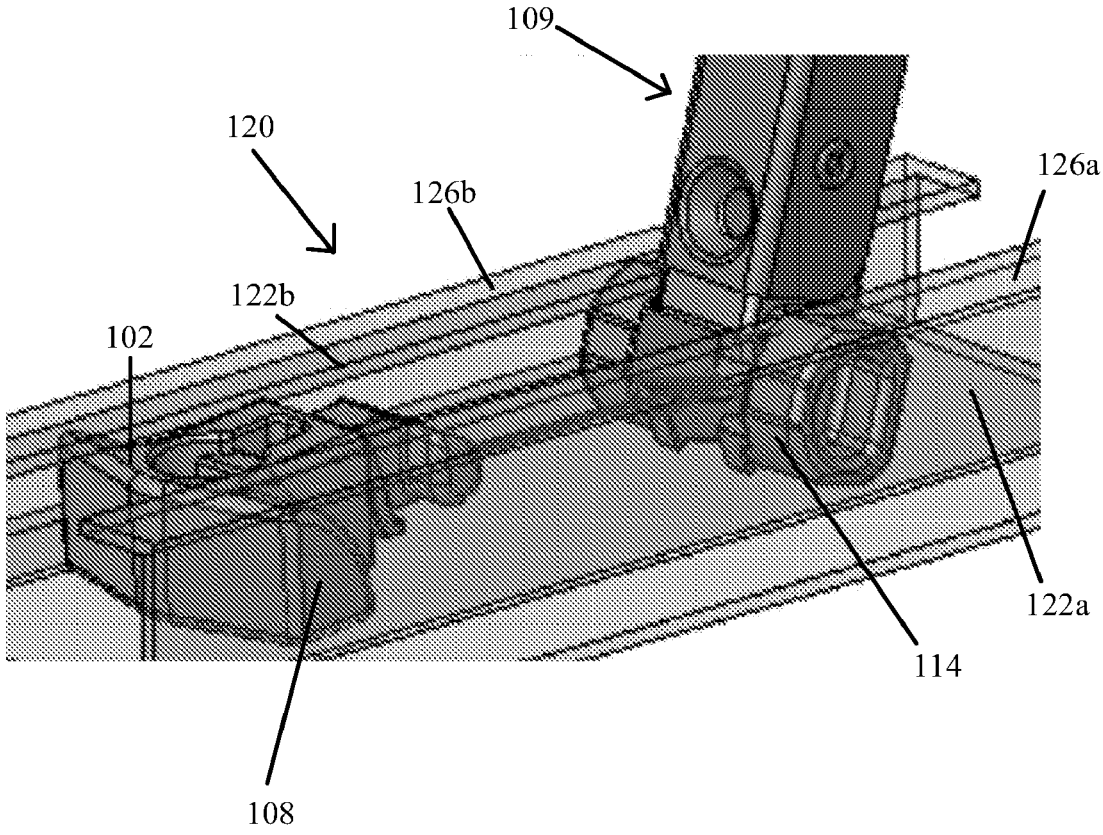
FIG. 4 shows one of the steps in the assembly of the carrier and balance assembly after installation in the jamb channel.
Figure 5:
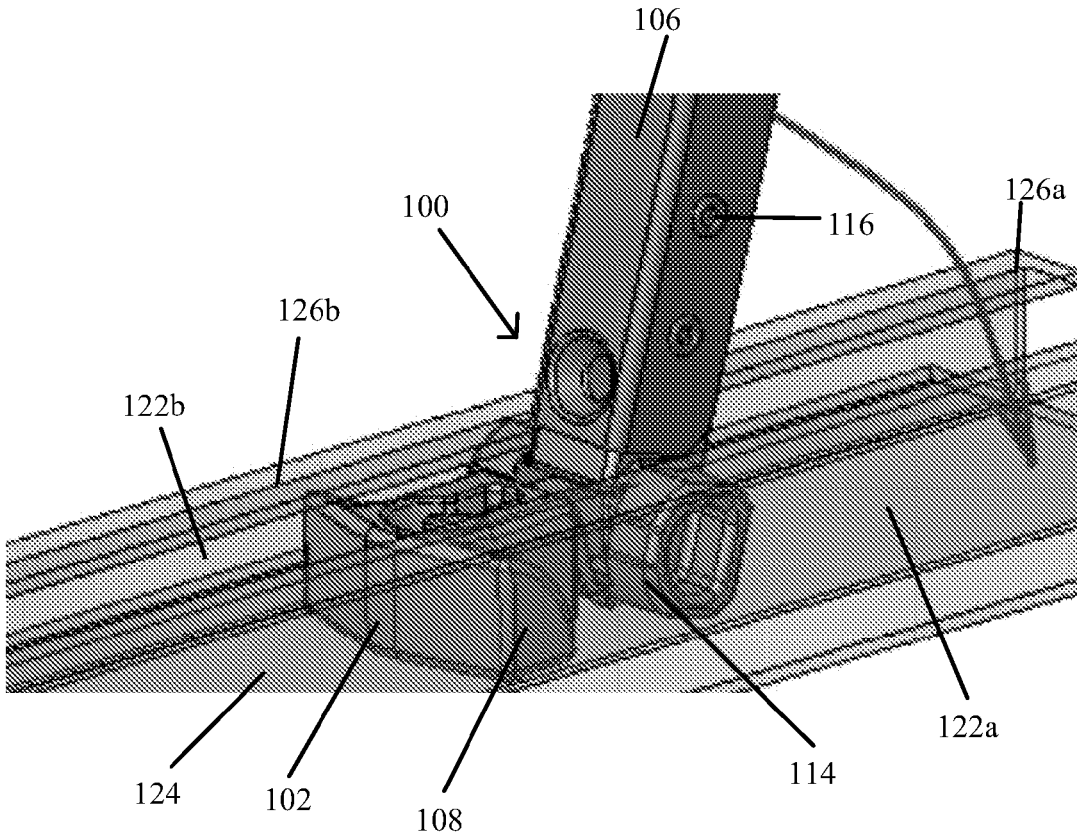
FIG. 5 shows a further step in the assembly process.

Once the respective shoulders 108 and 114 of carrier 102 and hanger 104 are inserted into the jamb channel 120, the two components are ready to be locked together. The first step is to incline the carrier 102 so that it lies against the back wall 124 of the jamb channel 120 with its locking tab 110 oriented toward the hanger 104 (FIG. 4). The two parts are then urged together such that the locking tab 110 engages the locking channel 112. Referring to FIG. 5, once locking tab 110 is inserted into locking channel 112, the hanger-balance subassembly 109 is fully inclined into the jamb channel 120 until the full length of balance 106 rests against the back wall 124. Referring now to FIG. 6A, at least one resilient snap 130 on carrier 102 begins to engage a mating protrusion 132 on hanger 104. FIG. 6B is a cross section view of the carrier and balance assembly 100 after the carrier 102 is connected to hanger 104. A projection 133 on carrier 102 begins to engage a ledge 135 on hanger 104. Referring now to FIG. 7B, as the hanger and balance subassembly 109 is fully inclined, the full engagement of the projection 133 with the ledge 135 acts as a fulcrum to facilitate the locking of the resilient snaps 130 with its corresponding protrusion 132 to non-permanently lock together the carrier and the hanger (see FIG. 7A).

Once the carrier and balance assembly 100 abuts the back wall 124 of the jamb channel 120, the outer ends of shoulders 108 and 114 of the carrier 102 and hanger 104, respectively, may establish a 4-point contact with the side walls 122*a* and 122*b* of the jamb channel if the lengths of shoulders 108 and 144 are substantially the same. A 4-point contact may be desirable to substantially reinforce the stability of the carrier and balance assembly 100 with respect to the axis i-i of the jamb channel 120. The elimination of unnecessary motion helps to keep the various components properly aligned when the carrier is locked. However, if the lengths of the shoulders 108 and 144 are substantially different for reasons that might include harmonization of various components to reduce inventory complexity, then a 4-point contact may not be achieved.

FIG. 8A shows a bobbin 202 of an optional conventional block and tackle balance 200 connected to the hanger 104 of the carrier and balance assembly 100 by connecting means 208. Cord 204 connects the bobbin 202 to other components of the block and tackle balance (not shown). FIG. 8B shows the carrier and balance assembly 100 of the invention connected to the spiral rod 302 of a conventional spiral rod balance 300 by the appropriate connecting means 308. FIG. 8C shows the inventive carrier and balance assembly 100 connected to one end of the spring 402 of a conventional constant force spring balance 400 by appropriate connecting means 408.

In the event that one or more of the component parts of the carrier and balance assembly 100 becomes defective or for some reason must be replaced, the assembly method described above can be reversed so that the individual defective part can be removed without damaging the jamb channel 120. This makes repair of the carrier and balance assembly 100 relatively inexpensive since only the defective part need be removed. The method of installation and removal of the carrier and balance assembly 100 is easy enough so that the average homeowner (or building maintenance personnel) can perform the necessary repair himself or herself, thus ultimately saving the window manufacturer the expense of having to send a service technician to the location of the installed window to perform the required repair.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A two piece carrier and balance assembly for a window frame comprising:

a) a first component including a carrier having a first end and a second end, the first end including a locking means and a pair of shoulders having an axis, the second end including a locking tab, b) a second component being a hanger-balance subassembly, the hanger-balance subassembly comprising:

i) a hanger having a first end and a second end, the first end including a pair of shoulders having an axis and a locking channel for receiving the locking tab of the carrier, the second end including an extension portion; and ii) a balance having a first end and a second end, the first end being connected to the extension portion of the hanger.

2. The carrier and balance assembly of claim 1 wherein the carrier and balance assembly is capable of being installed into a jamb channel of a window, said jamb channel having opposing side walls, a back wall and a flange integral with each side wall.

3. The carrier and balance assembly of claim 2 wherein the pair of shoulders of the carrier and the pair of shoulders of the hanger are of substantially equal length to achieve a 4-point contact with the side walls of the jamb channel.

4. The carrier and balance assembly of claim 1 wherein the balance is selected from the group consisting of a block and tackle mechanism, a spiral rod/torsion spring mechanism, a constant force mechanism, an elastomeric device, a linear slide mechanism and an electrical powered mechanism.

5. The carrier and balance assembly of claim 1 further comprising connection means for securing the extension portion of the hanger to the first end of the balance.

6. A method for disassembling the carrier and balance assembly of claim 1 comprising:

a) inclining the hanger-balance subassembly such that the hanger-balance subassembly is substantially perpendicular to an axis of a jamb channel;

b) disengaging the locking tab of the carrier from the locking channel of the hanger; and c) inclining the separated carrier away from a back wall of the jamb channel.

7. The method of claim 6 further comprising rotating the carrier approximately 90 degrees so that the axis of the shoulders of the carrier is substantially parallel to the axis of the jamb channel and removing the carrier from the jamb channel.

8. The method of claim 6 further comprising rotating the hanger of the hanger-balance subassembly approximately 90 degrees so that the axis of the shoulders of the hanger is substantially parallel to the axis of the jamb channel and removing the hanger-balance subassembly from the jamb channel.

9. A method for installing a carrier and balance assembly into a jamb of a window;

the jamb having a channel defined by two opposing side walls, each side wall having an outer edge, a back wall and an opening between the outer edges of the two side walls, the outer edge of each side wall having a flange bent at substantially a 90 degree angle from its respective side wall; the jamb channel having an axis; the carrier and balance assembly including two separate components, the first component being a carrier and the second component being a hanger-balance subassembly; the carrier having a first end and a second end, shoulders having an axis at the first end and a locking tab at the second end; the hanger of the hanger-balance subassembly having a first end and a second end, shoulders having an axis and a locking channel at the first end for receiving the locking tab of the carrier and an extension portion at the second end; said method comprising the steps of:

a) orienting the axis of the shoulders of the carrier to be parallel with the axis of the jamb channel;

b) orienting the axis of the shoulders of the hanger of the hanger-balance subassembly to be parallel with the axis of the jamb channel;

c) inserting the carrier through the opening of the jamb channel and rotating the carrier approximately 90 degrees so that each shoulder of the carrier abuts an underside of the flange of the side wall to which it is adjacent;

d) inserting the hanger of the hanger-balance subassembly through the opening of the jamb channel and rotating the hanger-balance subassembly approximately 90 degrees so that each shoulder of the hanger abuts an underside of the flange of the side wall to which it is adjacent;

e) aligning the locking tab of the carrier with the locking channel of the hanger;

f) inserting the locking tab of the carrier into the locking channel of the hanger; and g) inclining the hanger-balance subassembly until it abuts the back wall of the channel.

10. The method of claim 9 further comprising a projection on the carrier that lockingly engages a ledge on the hanger as the hanger-balance subassembly is inclined onto the back wall of the channel.

11. The method of claim 9 wherein the hanger-balance subassembly is of a sash balance type selected from the group consisting of a block and tackle mechanism, a spiral rod/torsion spring mechanism, a constant force mechanism, an elastomeric device, a linear slide mechanism and an electrically powered mechanism.

12. A method for installing a carrier and balance assembly into a jamb of a window assembly; the jamb having a channel defined by two opposing side walls, each side wall having an outer edge, a back wall and an opening between the outer edges of the two side walls, the outer edge of each side wall having an integral flange at substantially a 90 degree angle from its respective side wall; the jamb channel having an axis; the carrier and balance assembly including a carrier, a hanger and a balance, the carrier having shoulders and the hanger having shoulders; said method comprising the steps of:

a) inserting the carrier and balance assembly into an end of the jamb channel prior to the assembly of the window; and b) sliding the carrier and balance assembly along the jamb channel so that the entire carrier and balance assembly is fully contained within the jamb channel.

13. The method of claim 12 wherein the balance is selected from the group consisting of a block and tackle mechanism, a spiral rod/torsion spring mechanism, a constant force mechanism, an elastomeric device, a linear slide mechanism and an electrically powered mechanism.

14. The method of claim 12 wherein the shoulders of the carrier and the shoulders of the hanger are of substantially equal length to achieve a 4-point contact with the side walls of the jamb channel.

* * * * *